US009238382B2

(12) United States Patent
Merdassi

(10) Patent No.: US 9,238,382 B2
(45) Date of Patent: Jan. 19, 2016

(54) GREETINGS CARD AND A BLANK FOR FORMING IT

(71) Applicant: Jamal Merdassi, London (GB)

(72) Inventor: Jamal Merdassi, London (GB)

( * ) Notice: Subject to any disclaimer, the term of this patent is extended or adjusted under 35 U.S.C. 154(b) by 29 days.

(21) Appl. No.: 14/296,019

(22) Filed: Jun. 4, 2014

(65) Prior Publication Data

US 2014/0287182 A1 Sep. 25, 2014

Related U.S. Application Data

(63) Continuation of application No. PCT/GB2012/000893, filed on Dec. 5, 2012.

(30) Foreign Application Priority Data

Dec. 5, 2011 (GB) ..... 1120876.6

(51) Int. Cl.

| | |
|---|---|
| ***B42D 15/04*** | (2006.01) |
| ***B42D 15/02*** | (2006.01) |
| ***A63H 37/00*** | (2006.01) |
| ***B65D 5/42*** | (2006.01) |

(52) U.S. Cl.

CPC ..... *B42D 15/027* (2013.01); *A63H 37/00* (2013.01); *B42D 15/022* (2013.01); *B42D 15/04* (2013.01); *B65D 5/4291* (2013.01); *B65D 2203/12* (2013.01); *Y10T 428/16* (2015.01)

(58) Field of Classification Search

CPC ..... B42D 15/22; A63H 37/00

USPC ..... 428/124, 12, 130, 156; 40/124.03; 472/56

See application file for complete search history.

(56) References Cited

U.S. PATENT DOCUMENTS 5,435,787 A 7/1995 Ratcliffe

FOREIGN PATENT DOCUMENTS

| | | |
|---|---|---|
| GB | 729 679 | 5/1955 |
| GB | 2 255 025 | 10/1992 |
| GB | 2 276 095 | 9/1994 |
| GB | 2 325 866 | 12/1998 |

OTHER PUBLICATIONS

International Search Report from corresponding PCT application PCT/GB2012/000893.

*Primary Examiner* — Alexander Thomas
(74) *Attorney, Agent, or Firm* — Anderson Gorecki & Rouille LLP

(57) ABSTRACT

The present invention relates to greetings cards generally and to Christmas cards and novelty cards in particular. Greetings cards, usually packaged with an envelope, come in a variety of styles. There are both mass-produced as well as handmade versions that are distributed by hundreds of companies large and small. There is a belief that greetings cards are becoming bland; the sending of Christmas cards is often seen as a chore. Equally, there is an increasing number of cards which are sent to surprise the recipients, or joke cards, which may be sent to communicate emotions to a recipient. The present invention seeks to provide a solution to the problems addressed above. The present invention seeks to provide a novelty card which is simple to manufacture and can provide a novelty noise to be created when first used.

17 Claims, 5 Drawing Sheets

GREETINGS CARD AND A BLANK FOR FORMING IT

CROSS-REFERENCE TO RELATED APPLICATIONS

This application is a continuation of PCT/GB2012/000893, filed Dec. 5, 2012, the content of which is hereby incorporated herein by reference.

FIELD OF THE INVENTION

The present invention relates to greetings cards generally and to Christmas cards and novelty cards in particular.

BACKGROUND TO THE INVENTION

A greetings card generally comprises an illustrated, folded card featuring an expression of friendship or other sentiment. Although greetings cards are usually given on special occasions, such as birthdays, Christmas, or other holidays, they are also sent to convey thanks or express other feelings. Greetings cards, usually packaged with an envelope, come in a variety of styles. There are both mass-produced as well as handmade versions that are distributed by hundreds of companies large and small. Whilst typically inexpensive, more elaborate cards with die-cuts or glued-on decorations may cost GB £5 each, or more.

In western societies and increasingly in other societies, many people traditionally mail seasonally themed cards to their friends and relatives in December at or around Christmas time. Many service businesses also send cards to their customers in this season, usually with a Christmas message or what is deemed by some to be a universally acceptable non-religious message such as "happy holidays" or "seasons' greetings". There is a belief that greetings cards are becoming bland; the sending of Christmas cards is often seen as a chore. Equally, there is an increasing number of cards which are sent to surprise the recipients, or joke cards, which may be sent to communicate emotions to a recipient.

JP 2003039860 provides a card such as a Christmas card, greeting cards or the like and comprises a card body and a cracker comprising a powder body encased in a cracker body case having a firing opening at the forward end, and a pull string passed through the powder body and being led out to the rear of the cracker body case is fixed onto the paper plane of a card body.

OBJECT OF THE INVENTION

The present invention seeks to provide a solution to the problems addressed above. The present invention seeks to provide a novelty card which is simple to manufacture and can provide a significant difference in operation.

STATEMENT OF THE INVENTION

In accordance with a first aspect of the invention, there is provided a novelty card, formed from a sheet material having first and second sides, said card comprising: a first panel hingedly connected to a second panel via a third panel; a fourth panel hingedly connected to the second panel via a fifth panel; first and second tabs and a sixth panel, respectively extending from the first, fifth and second panels; the third and fifth panels being foldable whereby the third and fifth panels can overlay a portion of the second panel, whereby to bring the first and fourth panels toward each other; the first and second tabs and sixth panel being foldable such that they can fold over respective first, fourth and second panels; wherein first and fourth panels are attached to each other by way of a releasable cracker snap arrangement, the cracker snap arrangement being activated upon separation of the first and fourth panels, the second and sixth panels enclosing the releasable cracker snap arrangement.

Accordingly a card is provided which, when firmly held at opposite sides, which sides are pulled away from each other, a cracker snap mechanism is caused to operate whereby to cause a bang to issue, with any smoke and any debris being contained between the second and sixth panels. Silver fulminate is typically the active chemical for such snaps and is often used in combination with potassium chlorate.

Conveniently, the cracker snap arrangement comprises a layer of cracker snap material attached to an overlapping section of the first and fourth tabs, the said first tab having a layer of cracker snap along an edge portion on the first side; said second tab having a layer of cracker snap along an edge portion on the second side; the cracker snap arrangement being activated upon separation of the first and fourth panels, which are attached, respectively to the first and second tabs.

Alternatively, the cracker snap arrangement comprises a prepared length of cracker snap material comprises an two tail-like element joined with a cracker snap join, the opposite ends of the tails being respectively fastened to at least one of the first panel and/or the first tab and the fourth panel and/or the second tab.

The card can be adapted to stand up on its own, prior to activation of the snap; the length of the base of the hinged panels can be greater than the length of the top, whereby the card, when placed upon a surface has a base area sufficient to enable the card to remain in an upstanding position. The sixth panel may also be adapted to provide a degree of support to the card, conveniently by being of a height greater than the card, with a flap that can be attached by folding, gluing or otherwise to the second panel or the hinge panels.

In another aspect of the invention, there is provided a blank for manufacture of the card in accordance with the first aspect of the invention.

BRIEF DESCRIPTION OF THE FIGURES

Some preferred embodiments of the invention will now be described, by way of example, with reference to the accompanying drawings, of which.

DETAILED DESCRIPTION OF THE PREFERRED EMBODIMENTS

There will now be described, by way of example only, the best mode contemplated by the inventor for carrying out the present invention. In the following description, numerous specific details are set out in order to provide a complete understanding to the present invention. It will be apparent to those skilled in the art, that the present invention may be put into practice with variations of the specific.

The present invention shall be conveniently described with reference to FIG. 1 which shows a blank 1 for a card, the blank conveniently comprising sheet card of a weight per area being in the region 150-300 $gm^{-2}$, preferably 200-250 $gm^{-2}$. Materials other than pulp-based card can be employed such as plastics sheet materials. The card can be pressed from a single sheet material and comprises a number of panels, as shall now be described.

Figure 1:
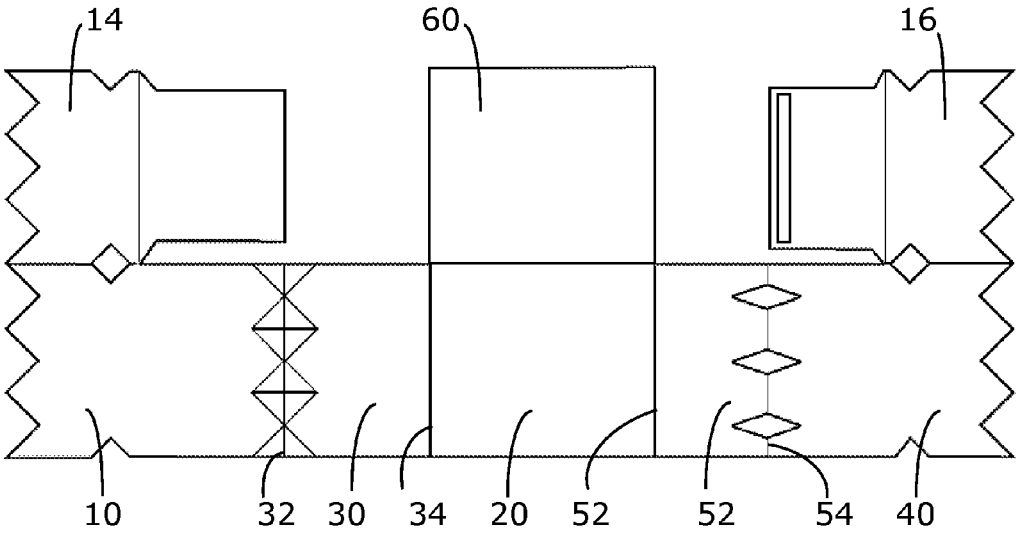
FIG. 1 shows a plan view of a blank used to manufacture the present invention.

Referring to the left hand side of FIG. 1, said card comprises a first panel 10 hingedly connects the centrally placed second panel 20 via a third panel 30. On the right hand side, a fourth panel 40 hingedly connects the second panel via a fifth panel 50. A message (not shown) can be placed on the reverse side of the second panel 20. First and second tabs 14, 16 and a sixth panel 60, respectively extend from the first, fourth and second panels.

The third and fifth panels 30 and 50 are scored or otherwise foldable along axes/lines 32, 34, 52, 54 respectively to define the separate panels. It can be seen that reference numerals 32 & 54 indicate somewhat complex folds, which create triangular crenulated features, as one variation. The fold lines are conveniently arranged in a parallel spaced apart relationship, to provide panels of a generally rectilinear shape. In the alternative, the fold lines between the first and third panel and the fifth panel and the fourth panel may diverge outwardly along what will be a lower edge 12 when the card is completed and is standing. Such a diverging line enables the lower edges of the second panel to be in a parallel spaced apart relationship from the lower edge of the first and fourth panels, whereby to enable the card to stand up on its own.

Figure 2:
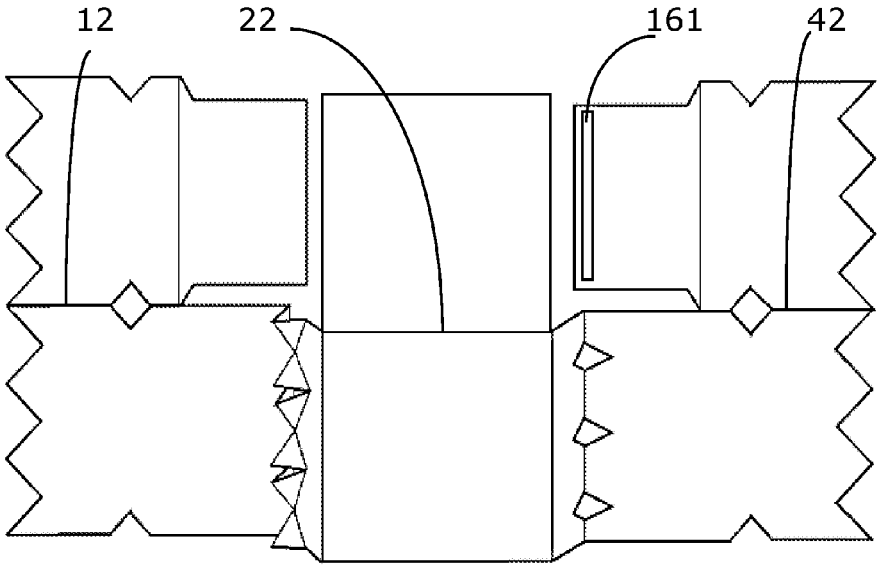
FIGS. 2-5 shows steps involved in the manufacture of a card.
Figure 3:
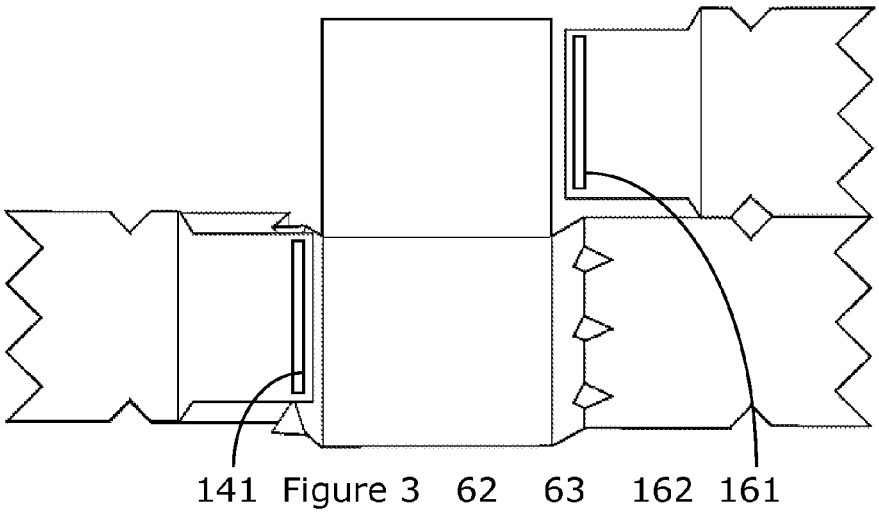
Figure 4:
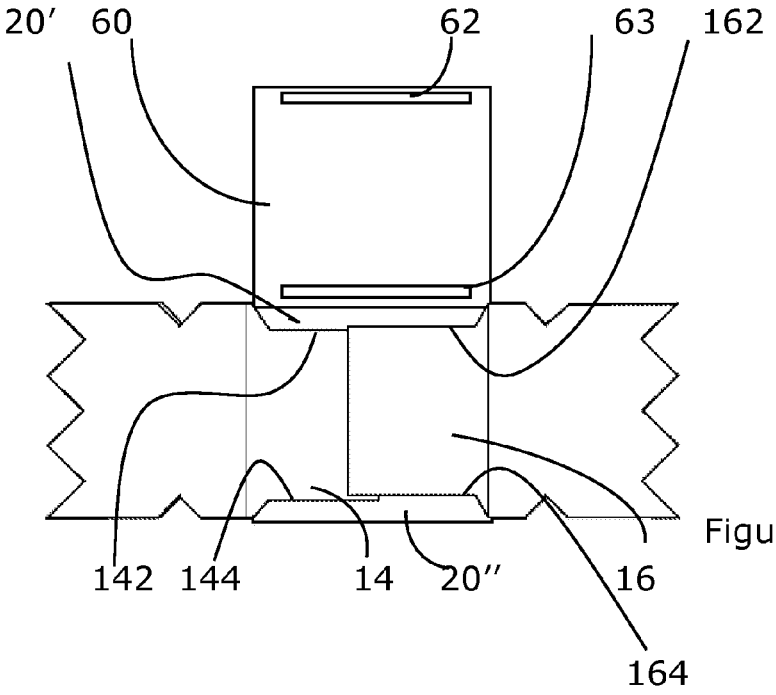

Referring now to FIG. 2, The first and second tabs and sixth panel are scored or otherwise foldable along the top part of first, fourth and second panels respectively, 12, 22, 42 whereby to enable such tabs and panels to fold over the panels to which they are connected. The first and fourth panels are shown directed toward each other; the third and fifth panels are urged to fold upon themselves, whereupon the first and fourth panels overlay the second panel; with reference to FIGS. 3 and 4, the first tab is folded down upon the first panel and the second panel and the second tab is folded down upon the fourth panel and the second panel, the third panel and the fourth panel folding upon the opposite side of the card. In this instance silver fulminate (cracker snap chemical) coatings 141, 161 are applied along adjacent edges of the tabs, upon first and second sides of the card, whereby, when the second tab is folded over, the cracker snap material is fused together. In the alternative a pre-prepared cracker snap material is applied to the tabs such that the pre-prepared cracker snap is adhesively secured to a first side of one tab and then adhesively secured to the facing portion of the other tab. Additionally, panel 60 has two adhesive strips 62, 63, whereby to enable panel 60 to be attached to panel 20 at areas 20' and 20", which areas are not covered by tabs 14, 16 by reason of the tabs having waist sections defined between sides 142 and 144 and 162 and 164 on tabs 14 and 16 respectively.

Figure 5:
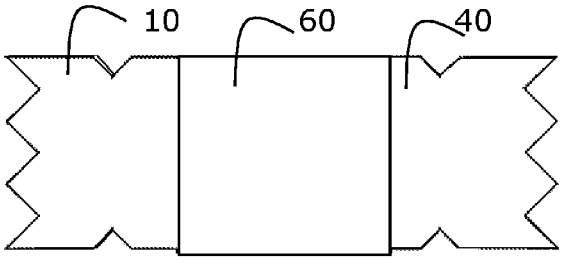

FIG. 5 shows the rear of the card once covered by panel 60. In the event that the hinge panels 30, 50 have divergent hinge or fold lines 32, 54, then the panel 60 will need to be alternatively secured, for example the panel may have a further fold line and in correspondence with the height of the card, with a further tab section extending into the volume defined between the second panel and the sixth panel. Variations of this design can be simply effected and enable the card to be self-supporting irrespective of having been opened or not. The hinge sections may be of a double-hinge construction whereby the card can lie flat in an envelope, for example.

Figure 6:
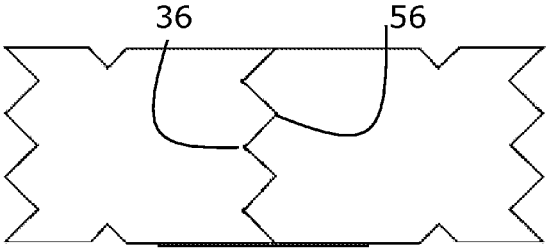
FIGS. 6 and 7 show a completed card in closed and opened configurations.
Figure 7:
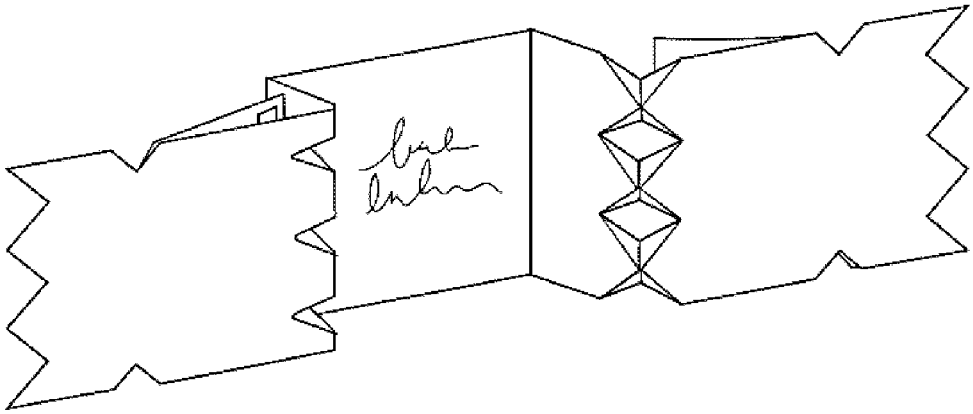

FIG. 6 shows a further detail, in a complete, un-opened card. As will be seen in FIGS. 1 and 2, for example, notches 32, 56 are provided in the hinges 36, 52. These notches are oppositely directed and positioned such that the first and fourth panels are attached. In order to open the card, the opposite side panels of the card are moved way from each other; the cracker snap material snaps in a loud fashion. FIG. 7 shows how the card looks after opening and the cracker snap has been activated. Panel 20 may bear a message 26, for example or may comprise a picture, or other similar sort of artwork.

Figure 11:
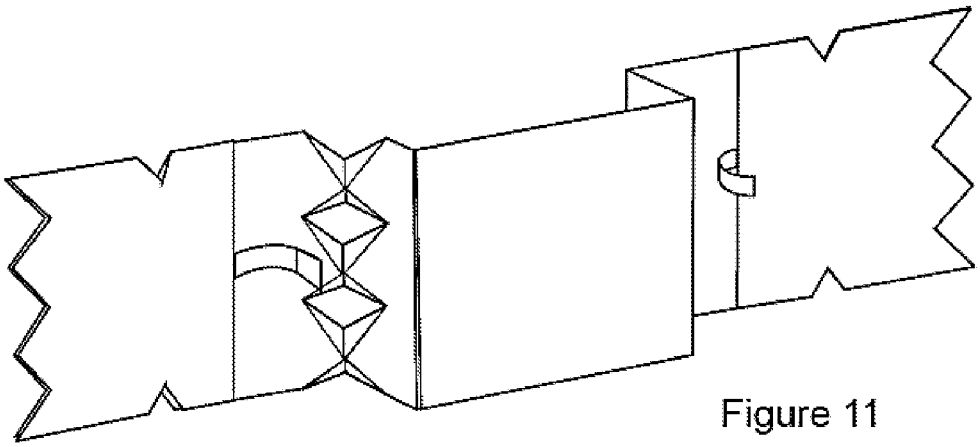
FIG. 11 shows a completed card in an opened configuration.

In a still further alternative, a pre-prepared cracker snap could be placed within the cracker and the ends of the cracker snap be attached, for example by the use of a suitable glue, to the first and fourth panels as seen with reference to FIGS. 8-11. Specifically, although tabs 14 and 16 need not be so big—since they do not need to join together—the main difference is that—the manufacture requires a different procedure and separately manufactured snaps to be glued in place, as best seen with reference to FIGS. 9*a* and 10. Whilst the cracker snap 90 may be glued to only one of the panels or tabs on each side, it is preferred that the cracker snap is glued to both panel 10, 40 and tab 14, 16 on each side. An additional benefit is that the card is urged to be in a compact position, once the cracker snap has been secured. As can be seen, from FIG. 11 especially, panel 60 provides a safety panel whereby any cracker snap material cannot be propelled outwardly, making the card extremely safe to use and suitable for children to handle and to open themselves. As will be appreciated, FIG. 11 shows card 2 after the cracker snap 90 as been activated and has become two separate parts, which remain attached to their respective side panels of the card.

Figure 8:
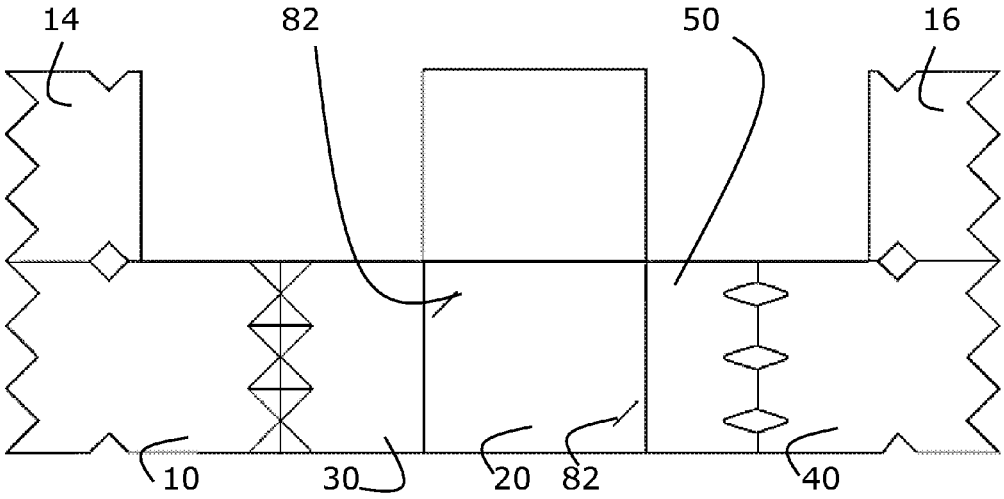
FIG. 8 shows a blank for a second embodiment.
Figure 9A:
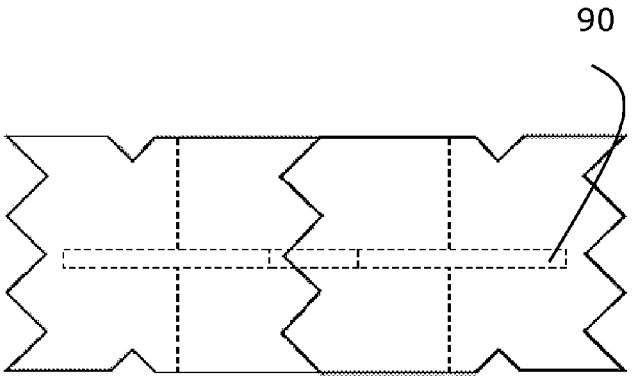
FIGS. 9*a* & 9*b* show an assembled second embodiment in plan view and edge view.
Figure 9B:
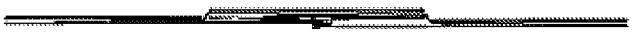
Figure 10:
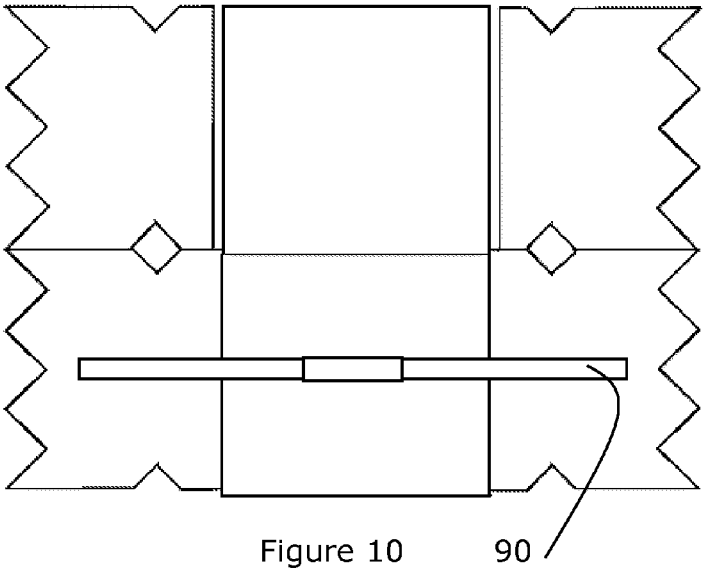
FIG. 10 shows the second embodiment in a part-complete state.

Instead of using glue strip 62, 63, with reference to FIGS. 8, 9*a* & 9*b*, the locking mechanism now consists of a combination of cut and folded lines that when assembled forms a locking mechanism by slotting one end into the other. FIG. 8 also shows two slots on the internal central panel of the card which can be utilised to hold a card, e.g. a credit-card sized gift card, which is concealed with he the card until it is pulled open.

Cracker snaps and material employed in such snaps are well known; they are known to produce a bang or snapping sound produced by the effect of friction on a layer of suitable chemical mixture or a card strip having a suitable chemical impregnation, similar to that used in a cap gun. Silver fulminate (AgCNO) is typically the active chemical for such snaps and is often used in combination with potassium chlorate. Such snaps typically contain approximately 200 milligrams of fine gravel impregnated with a minute quantity (approximately 80 micrograms) of silver fulminate. When pulled, the friction generates sufficient heat to detonate the tiny quantity of explosive, creating a small report from the supersonic detonation. The silver fulminate could be applied on one surface of two mutually adjacent surfaces of a cracker snap, with an abrasive material applied on the other mutually adjacent surface. Cracker snaps are designed to be incapable of producing damage (even when detonated against skin) due to the buffering effect provided by the much greater mass of the gravel medium. As will be known, other pressure-sensitive materials could be employed, such as mercury fulminate, potassium chlorate and sulphur; the choice of material being determined in the ability to make a noise, typically arising from a supersonic explosive sound, rather than any pyrotechnic display. Potassium perchlorate is the standard chemical presently employed in the fireworks industry—whilst it is a very powerful, and relatively safe mixture it provides a visual display and so is not suitable for a cracker snap as such. It will also be appreciated that extreme care needs to be taken in the use of such deflagrating compositions.

Further variations to the design can simply be accomplished, as will be appreciated by those skilled in the art. For example, the folded-over section may hide a novelty; card in the invention can come in a range of sizes, as will be appreciated by those skilled in the art, although it is believed that the cards will principally be on a similar scale of current greeting cards on the market. Additionally, a miniature cracker card could be utilised on the scale of a gift tag commonly used on packages and presents.

The invention claimed is:

1. A novelty card, formed from a sheet material having first and second sides, said card comprising:

a first panel hingedly connected to a second panel via a third panel;

a fourth panel hingedly connected to the second panel via a fifth panel;

first and second tabs and a sixth panel, respectively extending from the first, fifth and second panels;

the third and fifth panels foldable relative to each other whereby the third and fifth panels can overlay a portion of the second panel, whereby to bring the first and fourth panels toward each other;

the first and second tabs and sixth panel foldable relative to each other such that they can fold over respective first, fourth and second panels, wherein first and fourth panels are releasably attached to each other by way of a cracker snap arrangement in a folded state, the cracker snap arrangement being activated upon separation of the first and fourth panels, the second and sixth panels enclosing the releasable cracker snap arrangement.

2. A novelty card according to claim 1, wherein the cracker snap arrangement includes a chemical composition which comprises silver fulminate or mercury fulminate.

3. A novelty card according to claim 2, wherein the chemical composition further includes potassium chlorate.

4. A novelty card according to claim 1, wherein the cracker snap arrangement comprises a layer of chemical materials provided upon adjacent overlapping sections of the first and fourth tabs in a folded state of the card, the said first tab having a layer of chemical material along an edge portion on the first side; said second tab having a layer of chemical material along an edge portion on the second side; the cracker snap arrangement being defined by the two layers of chemical materials and being activated upon separation of the first and fourth panels, which are attached, respectively to the first and second tabs.

5. A novelty card according to claim 1, wherein the cracker snap arrangement comprises a prepared length of cracker snap material comprises a tail-like element formed from two joined elements, with a layer of chemical materials provided upon adjacent overlapping sections of each element, the opposite ends of the tail-like element being respectively fastened to at least one of the first panel and/or the first tab and the fourth panel and/or the second tab.

6. A novelty card according to claim 5, wherein the layer of chemical materials provided upon each adjacent overlapping sections of each element is the same, comprising a cracker snap chemical composition and a friction material.

7. A novelty card according to claim 5, wherein the layer of chemical materials provided upon each adjacent overlapping sections of each element is distinct; one chemical material comprising an inert friction material the other chemical material comprising a cracker snap chemical composition.

8. A novelty card according to claim 1, wherein a base of the hinged panels is greater than the top, whereby the card, when placed upon a surface has a base area sufficient to enable the card to remain in an upstanding position.

9. A novelty card according to claim 1, wherein the sixth panel is dimensioned so as to provide support to the card whereby, when placed upon a surface, the card has a base area sufficient to enable the card to remain in an upstanding position.

10. A novelty card according to claim 1, wherein the panels foldable with respect to each other are foldable by way of scores or fold lines defined in the card.

11. A novelty card according to claim 1, wherein the sheet material is of a weight between 100 and 350 $gm^{-2}$.

12. A novelty card according to claim 1, wherein the sheet material is produced from pulp based card.

13. A novelty card according to claim 1, wherein the sheet material is produced from plastics.

14. A blank for forming a novelty card from a sheet material having first and second sides, said blank comprising:

a first panel hingedly connected to a second panel via a third panel;

a fourth panel hingedly connected to the second panel via a fifth panel;

first and second tabs and a sixth panel, respectively extending from the first, fifth and second panels;

the third and fifth panels being scored or otherwise foldable whereby the third and fifth panels can overlay a portion of the second panel, whereby to bring the first and fourth panels toward each other;

the first and second tabs and sixth panel being scored or otherwise foldable such that they can fold over respective first, fourth and second panels, wherein first and fourth panels are attached to each other by way of a releaseable cracker snap arrangement, the cracker snap arrangement being activated upon separation of the first and fourth panels, the second and sixth panels enclosing the releasable cracker snap arrangement.

15. A blank for forming a novelty card from a sheet material according to claim 14, wherein the cracker snap arrangement comprises a layer of chemical materials provided upon first and second areas that overlap when the card is folded.

16. A blank for forming a novelty card according to claim 15, wherein the layer of chemical materials provided upon first and second areas that overlap when the card is folded is the same, comprising a cracker snap chemical composition and a friction material.

17. A blank for forming a novelty card according to claim 15, wherein the layer of chemical materials provided upon first and second areas that overlap when the card is folded are distinct; one chemical material comprising an inert friction material the other chemical material comprising a cracker snap chemical composition.

* * * * *